US007552600B2

(12) United States Patent
Fields

(10) Patent No.: US 7,552,600 B2
(45) Date of Patent: Jun. 30, 2009

(54) NECK ORNAMENT

(76) Inventor: Marcia Kay Fields, 736 Renoir Ct., Sun Valley, NV (US) 89433

( * ) Notice: Subject to any disclaimer, the term of this patent is extended or adjusted under 35 U.S.C. 154(b) by 51 days.

(21) Appl. No.: 11/026,215

(22) Filed: Dec. 30, 2004

(65) Prior Publication Data

US 2006/0144082 A1 Jul. 6, 2006

(51) Int. Cl.
*A44C 15/00* (2006.01)

(52) U.S. Cl. ..... 63/3; 63/3.1

(58) Field of Classification Search ..... 63/3, 63/3.1, 4, 13, 11, 21–23, 33, 1.18, 40
See application file for complete search history.

(56) References Cited

U.S. PATENT DOCUMENTS 1,578,461 A * 3/1926 Morris ..... 63/3.1
1,762,502 A * 6/1930 Brooks ..... 63/1.18
3,727,609 A 4/1973 Hale
D256,003 S * 7/1980 Barr ..... D11/43
4,527,316 A 7/1985 Murphy
4,551,993 A 11/1985 Nagahori
4,718,252 A 1/1988 Fossas
5,279,132 A * 1/1994 Swaim ..... 63/3.1
6,138,356 A 10/2000 Hertelendy
6,142,623 A * 11/2000 Jones ..... 351/156
6,202,443 B1 3/2001 Grosser-Samuels
6,293,127 B1 9/2001 Nakagawa
6,880,363 B2 * 4/2005 Ma ..... 63/3.1
2003/0019242 A1 1/2003 White

* cited by examiner

*Primary Examiner*—Jack W. Lavinder
(74) *Attorney, Agent, or Firm*—Advantia Law Group; Michael W. Starkweather; Jason P. Webb

(57) ABSTRACT

There is a neck ornament and/or neck ornament attachment having properties which tend to resist improper displacement of the neck ornament while in operation and/or which tend to induce proper displacement of the neck ornament while in operation. There may be a circumscribing element, encompassing the neck; a coupling device, for coupling end portions of the circumscribing element; and an anchoring device. The anchoring device may be coupled to a posterior portion of the circumscribing element, extending therefrom, and may be configured to anchor proper disposition of the neck ornament, without the use of an adhesive. There may be a neck ornament attachment including an anchoring device which may be configured to attach to a coupling device of a neck ornament.

11 Claims, 7 Drawing Sheets

NECK ORNAMENT

BACKGROUND OF THE INVENTION

1. Field of the Invention

The present invention relates to ornaments worn around the neck, specifically to posterior neck ornaments and attachments.

2. Description of the Related Art

Ornaments worn around the neck are generally referred to as a necklace. Necklaces may be of many different structural configurations, thick or thin, rigid or flexible, solid or hollow, heavy or light, smooth or disjointed and continuously coupled or attachably connected. Necklaces may be used in combination with a pendant of any kind or other jewelry to enhance their ornamental appeal. But, whatever the design, whatever the configuration, a necklace, as up to now conceived, must remain around the wearer's neck. A necklace ordinarily forms a closed loop encircling and thus latching on to the neck.

Many necklaces and other body adornments may be designed so that the decorative ornament such as a pendant, trinket or bauble is movably attached to the chain, string, leather strand, beads or other material that a person may wear around their neck or other body part such as the wrist, arm, leg, ankle, waist and the like. The decorative ornament is often attached to the necklace by a ring or similar attaching means that allows the chain, string, leather strand, beads or the like to move freely though the ring or similar attaching means. When a person places the necklace or other body adornment around their neck or other body part, the coupling device which fastens the two ends of the necklace together has a tendency to creep or walk from it's initial position at the back of the wearer's neck to the front of the wearer's body, often coming to rest adjacent to the decorative ornament such as a pendant, trinket or bauble that may be attached to the necklace.

Even in necklaces where the decorative ornament is attached to the chain, string, leather strand, beads or similar material in a manner that holds the decorative ornament in a fixed position relative to the chain or similar material, the coupling device or fastening means at the back of the neck has a tendency to creep or walk around to the front of the wearer's body. The result is a displaced decorative ornament or, in the extreme, reversal of the initial position of the coupling device and the decorative ornament.

In both types of necklaces, those with movably attached decorative ornaments and those with fixed decorative ornaments, creeping or walk-around of the coupling device from the back of the neck to the front of the neck leads to unsightly body adornment and frustration of the wearer in having to constantly readjust the necklace to its proper orientation. The creeping or walk-around problem has been observed in other types of body adornments as well such as bracelets, anklets, waist chains and the like.

What is needed is a neck ornament, or neck ornament attachment which resists displacement from a person's back location. Additionally needed is a neck ornament or attachment which tends to keep a coupling device centered behind the neck or back of the wearer. Also needed is a neck ornament or attachment which enhances the decorative value of the neck ornament.

SUMMARY OF THE INVENTION

The present invention has been developed in response to the present state of the art, and in particular, in response to the problems and needs in the art that have not yet been fully solved by currently available neck ornaments. Accordingly, the present invention has been developed to provide a neck ornament and/or neck ornament attachment having properties which tend to resist improper displacement of the neck ornament while in operation and/or which tend to induce proper displacement of the neck ornament while in operation.

In one embodiment, there may be a neck ornament for being placed about a neck of a person, including a circumscribing element, a coupling device and an anchoring device. The circumscribing element may be configured to encompass the neck and has a first end portion and a second end portion. The coupling device may be connected to the circumscribing element and may be configured to couple the first end portion and the second end portion. The anchoring device may be coupled to a posterior portion of the circumscribing element, extending therefrom, and may be configured to anchor proper disposition of the neck ornament, without the use of an adhesive.

In another embodiment there may be a neck ornament attachment having an anchoring device, wherein the neck ornament attachment may be configured to couple to a posterior portion of a neck ornament, or necklace, as those known in the art. In another embodiment the anchoring device may be directly connected to the coupling device. In still another embodiment there may be a plurality of interconnected anchoring devices. In yet another embodiment the anchoring device may be a weighted rod-like structure. The anchoring device may include an attachment member, a pending member and a posterior decorative element.

The anchoring device may be configured to anchor proper disposition of the neck ornament primarily by weight of the anchoring device. Also, or alternatively, the anchoring device may be configured to anchor proper disposition of the neck ornament primarily by leveraged weight of the anchoring device.

In still yet another embodiment there may be a plurality of back decorative elements. Further, there may be a plurality of pending members connected to the circumscribing element and configured to cause the coupling device to tend to center behind a person when the neck ornament may be worn. In an additional embodiment the plurality of pending members may be generally permanently attached to the circumscribing element.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
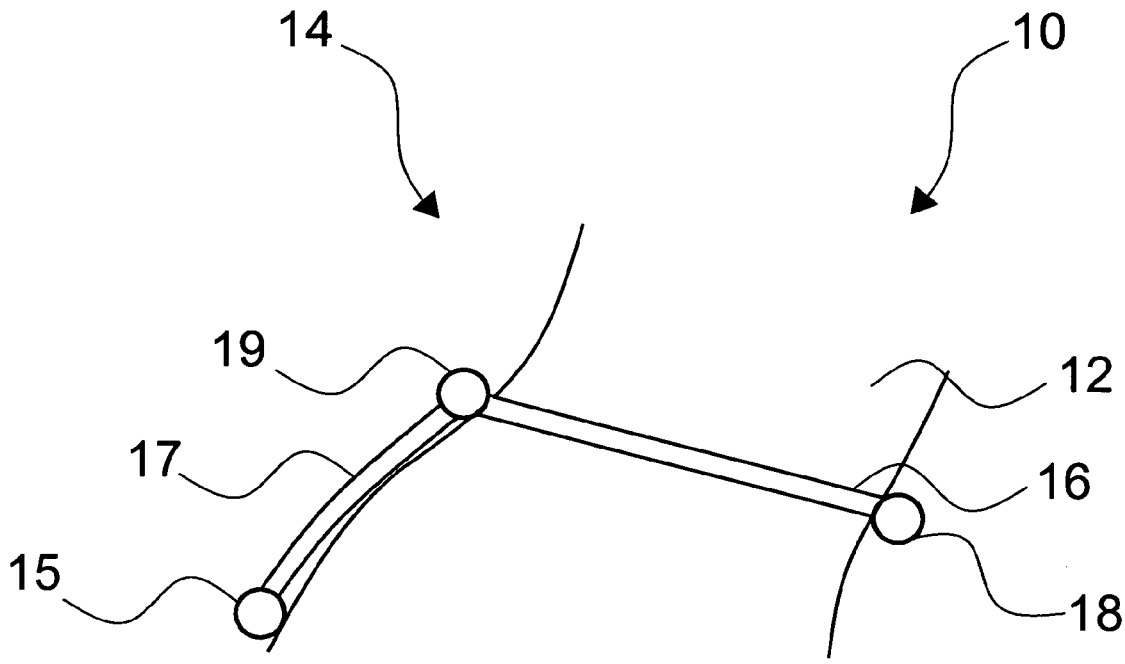
FIG. 1 illustrates a side view of a neck ornament worn on a person according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly. It is intended that the claims stand on their own with support from the specification.

Finally, the fact that the wording "an embodiment," or the like, does not appear at the beginning of every sentence in the specification, such as is the practice of some practitioners, is merely a convenience for the reader's clarity. However, it is the intention of this application to incorporate be reference the phrasing "an embodiment," and the like, at the beginning of every sentence herein where logically possible and appropriate.

FIG. 1 illustrates a side view of a neck ornament 10 worn on a person 14 according to one embodiment of the invention. Shown is a neck ornament 10 coupled to the neck 12 of a person 14. The neck ornament 10 includes a circumscribing element 16, such as a chain, disposed around the neck 12 of the person 14. Further, there may be a front decorative element 18, or elements, attached to the circumscribing element 16 displayed generally at the front, or anterior, of the person 14, as is commonly known in the art. Also, there may be a coupling device 19, such as a clasp, which typically detachably couples portions of the circumscribing element 16 together, for the purpose of removably attaching the neck ornament 10 to the neck 12 of the person 14.

In operation, the illustrated invention has the coupling device 19 disposed towards the back, or posterior, of the person 14. Additionally, there may be anchoring devices, preferably comprising a pending member 17 coupled, directly or indirectly, to the circumscribing element 16 at, or generally adjacent to, the coupling device 19. Moreover, there may be a back decorative element 15 coupled by the pending member 17 to the circumscribing element 16.

Figure 2:
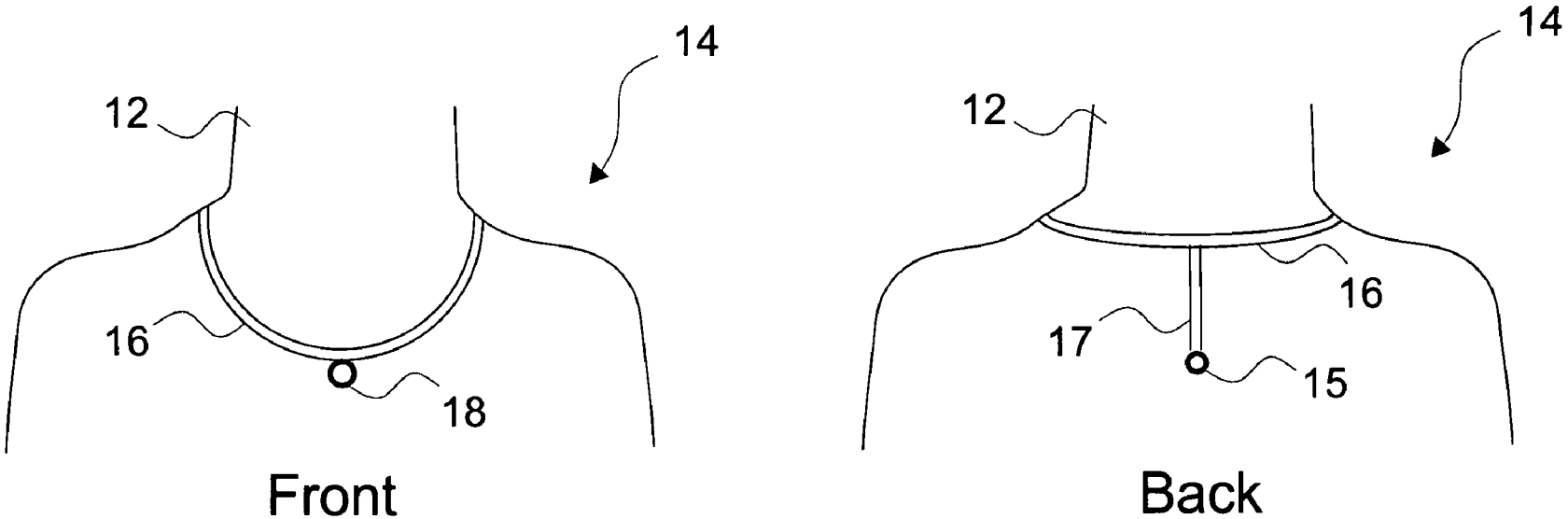
FIG. 2 illustrates front and back views, respectively, of a neck ornament worn on a person according to one embodiment of the invention.

FIG. 2 illustrates front and back views, respectively, of a neck ornament 10 worn on a person 14 according to one embodiment of the invention. A circumscribing element 16 typically circumscribes, in hole or in part, a neck 12 of a person 14. A front, or anterior, decorative element 18 may be attached to the circumscribing element 16 at the front of the person 14. Typically the front decorative element 18 significantly impacts the disposition of the neck ornament 10 because of weight and/or structure.

The coupling device 19 typically attaches at least two portions of the circumscribing element 16, generally behind the neck 12 of the person 14. Pending from the circumscribing element 16 at the coupling device 19 may be a pending member 17. The pending member 17 couples a back decorative element 15 to the circumscribing element 16. Being attached to the coupling device 19, the pending member 17 and back decorative element 15 significantly impact the disposition of the coupling device 19. Specifically, it is intended that the coupling device may not significantly traverse the neck 12 and/or shoulders without additional disposition of the coupled pending member 17 and back decorative element 15. Therefore, the coupling device 19 and circumscribing element 16 tend to remain properly disposed in a generally centrally located position at the anterior neck 12 or shoulder of the person 14.

Figure 3B:
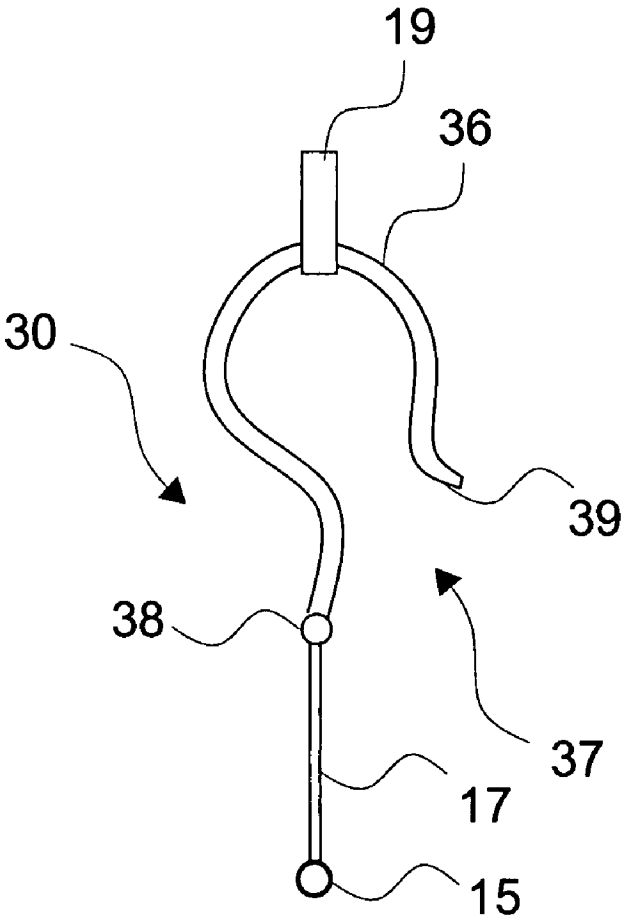
FIGS. 3A and 3B illustrate front and side views, respectively, of a neck ornament attachment according to one embodiment of the invention.
Figure 3A:
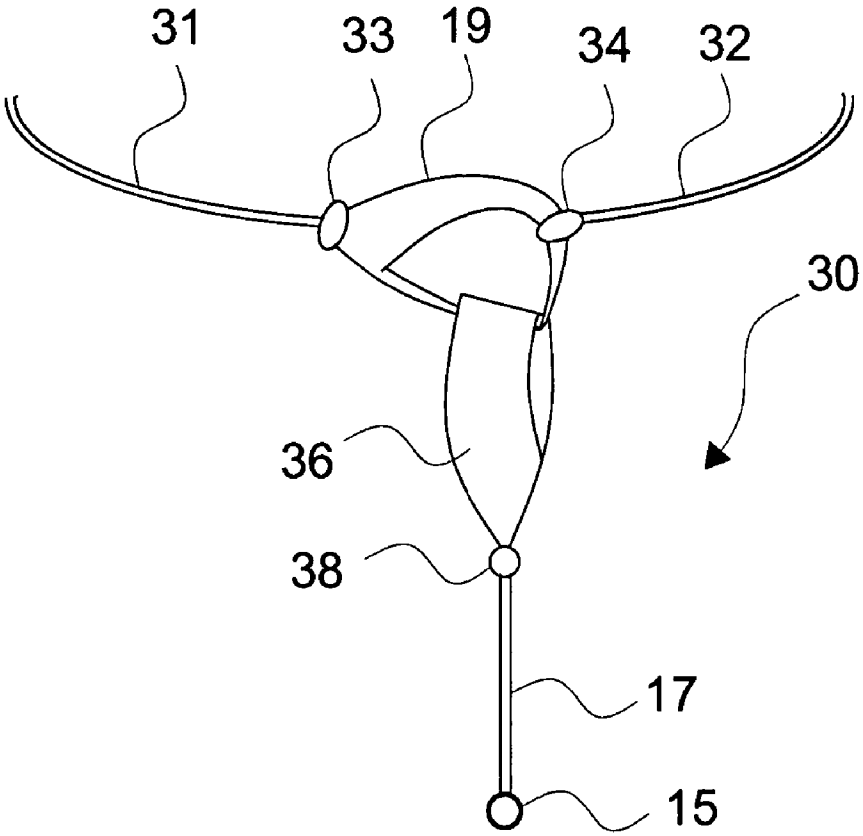

FIGS. 3A and 3B illustrate front and side views, respectively, of a neck ornament attachment 30 according to one embodiment of the invention. A first end portion 31 may be attached to a first circumscribing element hoop 33 which may be attached to a coupling device 19. A second end portion 32 may be attached to a second circumscribing element hoop 34 which may be attached to the coupling device 19. There may be a pending member hook 36, or attachment member, configured to removably attach to the coupling device 19. A pending member hoop 38 attaches the pending member hook 36 to a pending member 17 which may be attached to a back decorative element 15.

The neck ornament attachment 30 comprises the pending member hook 36, the pending member hoop 38, the pending member 17, and the back decorative element 15. As illustrated, the pending member hook 36 includes a U-shaped portion configured to couple with the coupling device 19 and remain coupled by influence of gravity and/or friction. There may be also a hook end 39 bending generally away from the pending member hoop 38 to facilitate connection of the pending member hook 36 to the coupling device 19 by creating a narrowing channel 37.

A weight of the neck ornament attachment 30 facilitates continued connection of the pending member hook 36 to the coupling device 19. In operation, the weight of the neck ornament 10 combined with nature of the connection of the pending member hook 36 and the coupling device 19 provides resistance to displacement of the coupling device 19 from a position behind a neck 12 (see FIG. 1) of a person 14 (see FIG. 1). Additionally, the weight and/or leveraged weight of the neck ornament attachment 30 tends to exert forces tending to keep the neck ornament 10 (see FIG. 1) properly positioned. Preferably, the coupling device 19 is kept centered behind the neck 12 of the person 14.

Figure 4B:
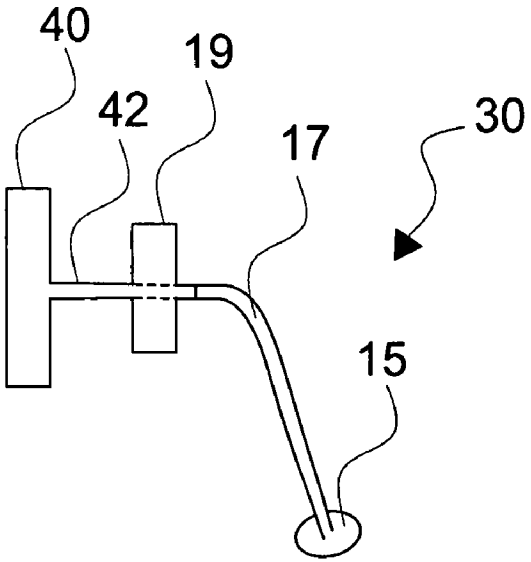
FIGS. 4A and 4B illustrate front and side views, respectively, of a neck ornament attachment according to one embodiment of the invention.
Figure 4A:
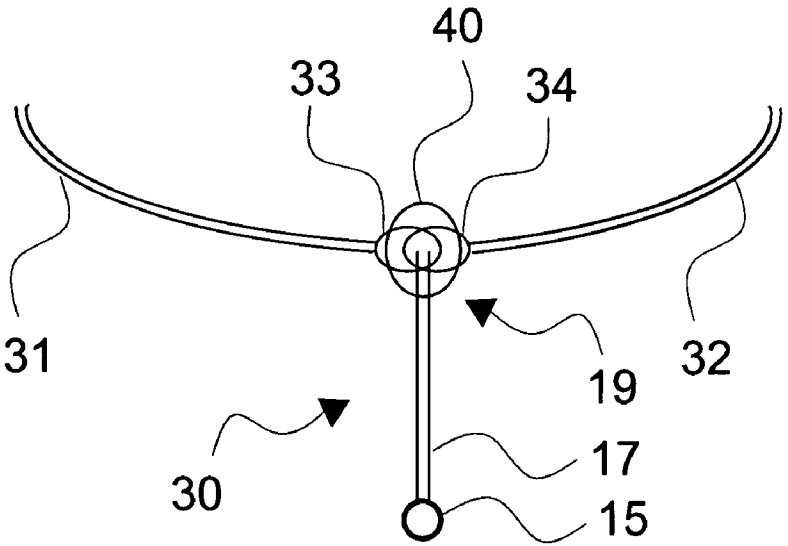

FIGS. 4A and 4B illustrate front and side views, respectively, of a neck ornament attachment 30 according to one embodiment of the invention. A first end portion 31 may be attached to a first circumscribing element hoop 33. A second end portion 32 may be attached to a second circumscribing element hoop 34. The second circumscribing element hoop 34 may be attached to the first circumscribing element hoop 33, which comprises a coupling device 19. There may be a pending member disc 40, or attachment member attached to a pending member 17, wherein the pending member 17 may be threaded through the coupling device 19 and may be circumscribed by at least either the first circumscribing element hoop 33 or the second circumscribing element hoop 34. There may be a back decorative element 15 attached to the pending member 17. The neck ornament attachment 30 comprises the pending member disc 40, the pending member 17 and the back decorative element 15.

In operation, in one embodiment, a weight of the neck ornament attachment 30 may exert a force pulling the pending member disc 40 against the coupling device 19. The pending member disc 40 may be configured to be too large to pass through the coupling device 19 and therefore maintains a connection between the neck ornament attachment 30 and the coupling device 19. The pending member disc 40 may be removably attached to the pending member 17 to allow for a mode of detachment. Additionally, the pending member 17 may attach to a pending member disc post 42 which threads through the coupling device 19 and may be circumscribed by at least one of the first circumscribing element hoop 33 or the second circumscribing element hoop 34.

Figure 5:
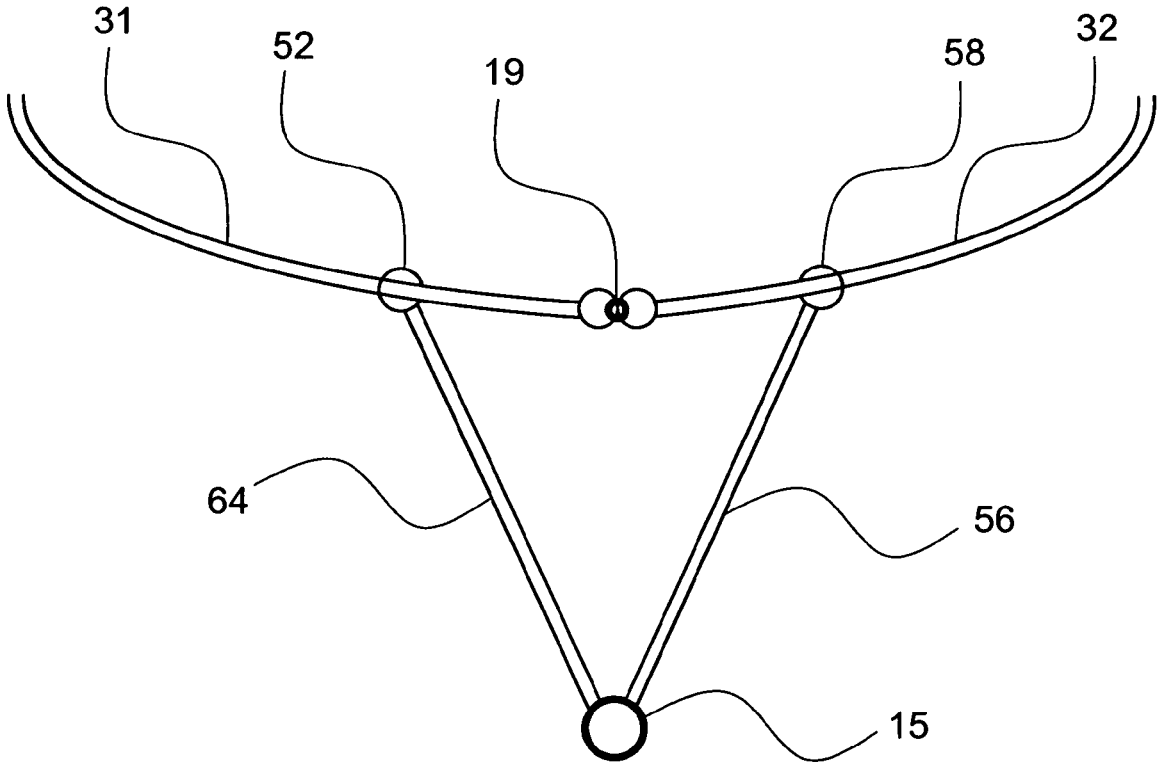
FIG. 5 illustrates a front view of a neck ornament attachment according to one embodiment of the invention.

FIG. 5 illustrates a front view of a neck ornament attachment 30 according to one embodiment of the invention. A first end portion 31 may be attached to a coupling device 19 which may be attached to a second end portion 32. A first pending member 54 may be slidably attached to the first end portion 31 by a first pending hoop 52. A second pending member 56 may be slidably attached to the second end portion 32 by a second pending hoop 58. Both the first pending member 54 and the second pending member 56 may be attached to a back decorative element 15. As illustrated, the first pending member 54 and second pending member 56 may be proximate to the coupling device 19 so that there is a distance between the first pending member 54 and the second pending member 56. The neck ornament attachment 30 comprises the first pending hoop 52, the second pending hoop 58, the first pending member 54, the second pending member 56 and the back decorative element 15.

In operation, the neck ornament attachment 30 influences the disposition of the first end portion 31 and the second end portion 32 and resists displacement of the coupling device 19. The first pending hoop 52 and second pending hoop 58 may be preferably a smaller size than the coupling device 19, thereby restricting the disposition of the coupling device 19 to be between the first pending hoop and the second pending hoop 58.

However, one skilled in the art would know of the numerous configurations of coupling devices and hoops wherein the hoops may be larger than the coupling device but the coupling device may be still generally restricted to be between the hoops. Also, preferably, the first pending hoop 52 and the second pending hoop 58 may be detachable from the first end portion 31 and the second end portion 32 respectively. Further, one skilled in the art would know that "hoops" are not merely closed metal circles, but may comprise a variety of shapes, materials and configurations.

Figure 6:
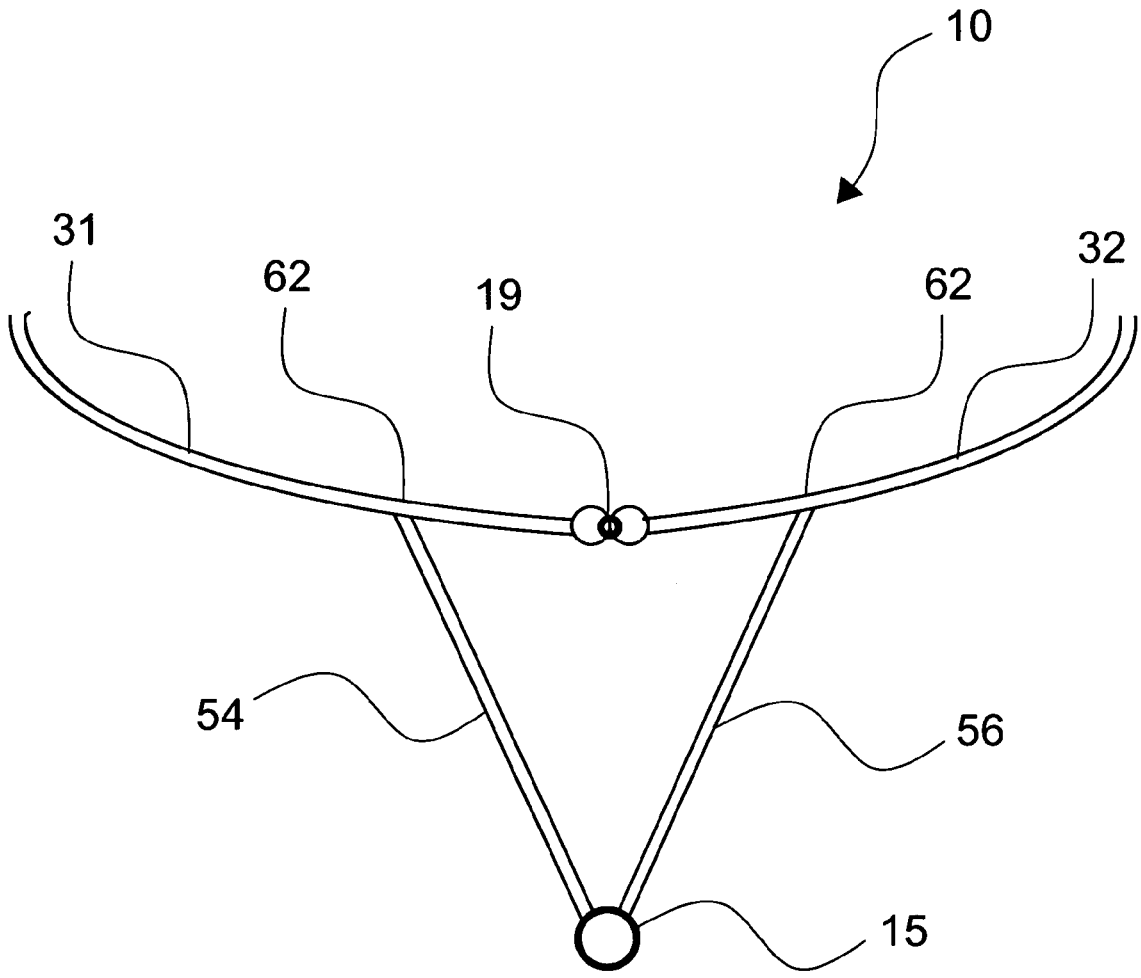
FIG. 6 is a front view of a back portion of a neck ornament according to one embodiment of the invention.

FIG. 6 is a front view of the back portion of a neck ornament 10 according to one embodiment of the invention. The back portion of the neck ornament 10 comprises a first end portion 31 connected to a coupling device 19 and a first pending member 54, a second end portion 32 connected to the coupling device 19 and a second pending member 56, wherein the first pending member 54 and the second pending member 56 may both be attached to a back decorative element 15. A locus of attachment 62 on the first end portion 31 between the first end portion 31 and the flint pending member 54 may be fixed. A locus of attachment 62 on the second end portion 32 between the second end portion 32 and the second pending member 56 may also be fixed. As illustrated, both the first pending member 54 and the second pending member 56 may be proximate to the coupling device 19 so that there is a distance between the first pending member 54 and the second pending member 56.

In operation, a weight of the first pending member 54, second pending member 56 and back decorative element 15 combined with the attachment configuration at each locus of attachment 62 resists displacement of the coupling device 19, tending to maintain the coupling device 19 in a location behind a neck 12 (see FIG. 1) of a person 14 (see FIG. 1).

Figure 7:
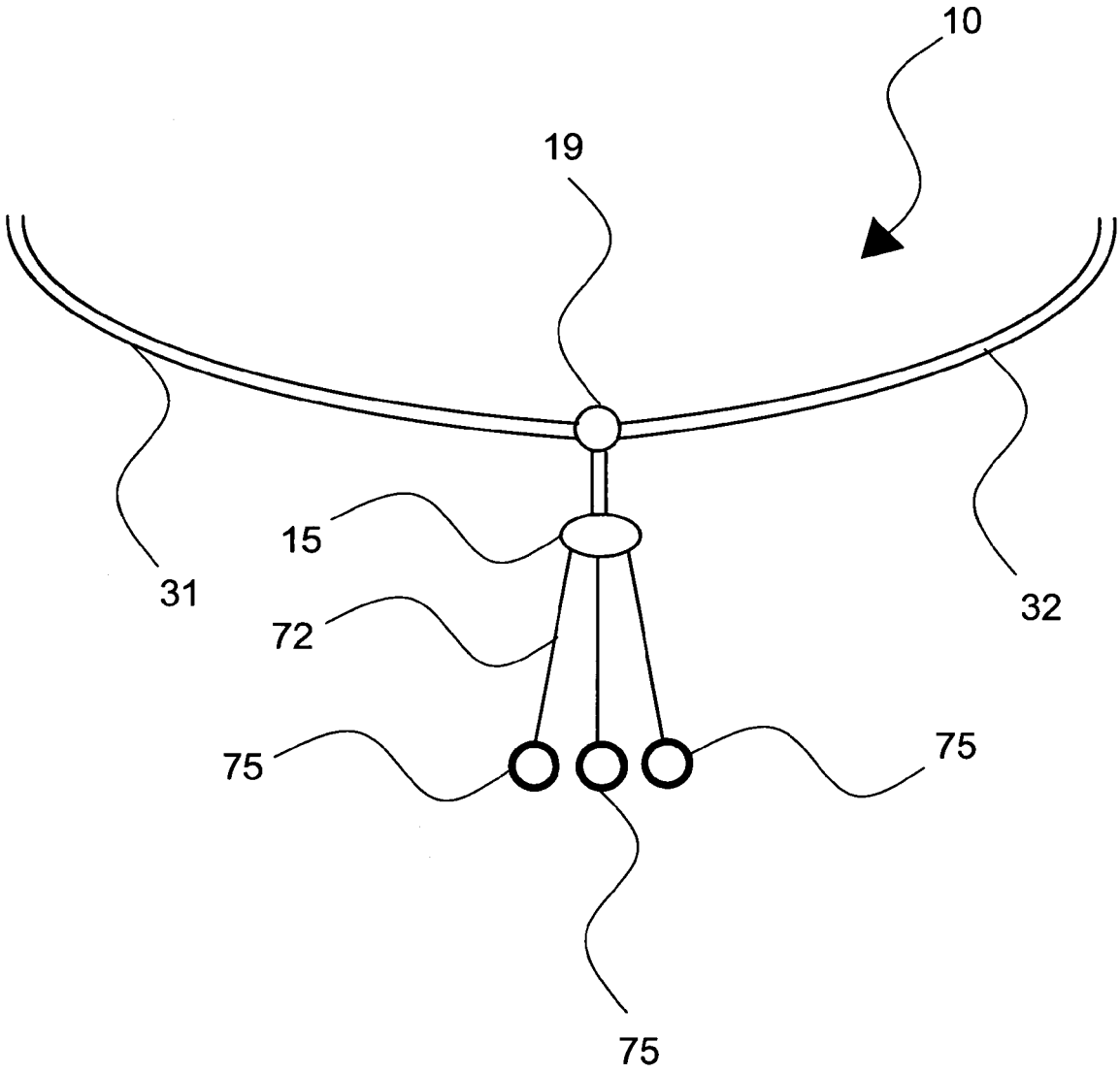
FIG. 7 illustrates a front view of a back portion of a neck ornament according to one embodiment of the invention.

FIG. 7 illustrates a front view of a back portion of a neck ornament 10 according to one embodiment of the invention. A first end portion 31 may be attached to a coupling device 19 which may be attached to a second end portion 32 and attached to a first back decorative element 15. The first back decorative element 15 may be attached to three pending members 72 which may be each attached to an additional back decorative element 75.

In operation, a weight of the first back decorative element 15, the three pending members and the three additional decorative elements 75 combined with the configuration of the attachment of the first back decorative element 15 to the coupling device 19, resists displacement of the coupling device 19. This orientation, or configuration, tends to maintain a proper disposition of the coupling device behind a neck 12 (see FIG. 1) of a person 14 (see FIG. 1).

The resistance may be due to several factors. One primary factor includes the leveraged weight of the three additional decorative elements 75. This factor may be also present in each of the other illustrated embodiments. Further, and also present to a degree in each of the other illustrated embodiments, in operation, significant surface area contact between skin of the person 14 and the neck ornament 10 further frictionally resists displacement of the coupling device 19. This effect may be enhanced where there may be a plurality of back decorative elements and pending members providing enhanced surface area contact with the skin, as illustrated in FIG. 7.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although the illustrations generally show symmetrical arrangements, asymmetrical arrangements are envisioned and within the scope of the invention. In particular, the decorative elements may be asymmetrical or asymmetrically arranged. The components of the neck ornament or neck ornament attachment may be asymmetrical or asymmetrically placed or arranged.

Additionally, although the figures illustrate circular decorative elements which are distinct from the pending members, the decorative elements may be of any shape or size and one skilled in the art would know that the pending member may simultaneously be the decorative member as well.

Also, while only two forms of coupling devices are disclosed, one skilled in the art would know that there are a great variety of types of coupling devices which may be used in neck ornaments, and correspondingly there are a great variety of configurations, wherein a neck ornament attachment may be attached to or near the coupling device of a neck ornament.

It is also envisioned that attachment locations, for example, as illustrated in FIG. 5, may be adjustable, or that the coefficient of friction between the hoops and the circumscribing element portions may be adjustable. The hoops may be free to traverse the circumscribing element portions or they may be generally fixed.

It is yet envisioned that the invention could resist displacement of a coupling device by force of weight, leveraged weight, force of friction, or by a combination of the listed forces as well as those not specifically listed herein. Also, it is envisioned that the invention may cause the coupling device to tend to center behind a person when worn.

In particular, in operation, where the anchoring device operates by leveraged weight, the center of gravity of the anchoring device may be below the lowest point of the circumscribing element. For example, where the anchoring device has significant weight, for example a weight distribution wherein a majority of the weight may be near the lowest portion of the anchoring device, displacement of the circumscribing member, especially angular displacement around the neck, may be strongly resisted by the leveraged weight having a low center of gravity with respect to the circumscribing member.

The words "anchoring device" are intended to include all of the above mentioned modes of operation, not only including operation by friction and not only including resisting motion. It is also envisioned that the connection between a coupling device and a pending member, or back decorative element or attachment component may be direct or indirect, may be fixed to one locus on the neck ornament or may be slidable and may be removable or generally permanent.

It is expected that there could be numerous variations of the design of this invention. An example is that the back decorative element may be attached to the pending member hook without a pending member. Another example is that the pending member may attach to the coupling device without a hook and without being attached to a distinct back decorative element. Additionally, the components of the neck ornament or neck ornament attachment may be modular, wherein diverse attachment components, pending members and back decorative elements may be configured to connect in varied modes.

Finally, it is envisioned that the components of the device may be constructed of a variety of materials. It is envisioned that a neck ornament or a neck ornament attachment could be constructed of any material, including but not limited to metal, plastic, minerals, resins, composites, natural materials, precious materials, alloys, and mixtures. It is further envisioned that the pending members and circumscribing elements may be constructed of identical or non-identical materials in identical or non-identical configurations. For example, the circumscribing elements may be constructed out of silver in a chain configuration, while the pending members may be constructed out of ceramic in a rod configuration. In another example, the circumscribing elements may be constructed out of various material in a chain configuration, while the pending members may be constructed out of various materials in a chain configuration.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A neck ornament for being placed about a neck of a person, comprising:

a circumscribing element configured to encompass the neck, including a front portion, a first end portion and a second end portion;

a coupling device, connected to the circumscribing element, and configured to couple the first end portion to the second end portion;

an anchoring device removably coupled at least proximate to the coupling device, and configured to anchor proper disposition of the neck ornament, so that the coupling device remains at a posterior position on a person, wherein the anchoring device is weighted to substantially balance a weight of the front portion;

wherein the anchoring device comprises an attachment member, a pending member connected to the attachment member and a posterior decorative element connected to the pending member; and wherein the anchoring device is a weighted elongated structure removably coupled to the coupling device through an attachment component that is designed to allow for easy attachment of the anchoring device to the neck ornament.

2. The neck ornament of claim 1, wherein the anchoring device is configured to anchor proper disposition of the neck ornament primarily by weight of the anchoring device.

3. The neck ornament of claim 1, further comprising a front decorative element coupled to the front portion of the circumscribing element, wherein the weight of the anchoring device is substantially similar to the weight of the front decorative element.

4. The neck ornament of claim 1, wherein the anchoring device is a weighted elongated structure.

5. The neck ornament of claim 1, wherein the anchoring device comprises an attachment member and a pending member connected to the attachment member.

6. A neck ornament for being placed about a neck of a person, comprising:

a circumscribing element configured to encompass the neck, including a front portion, a first end portion and a second end portion;

a coupling device, connected to the circumscribing element, and configured to couple the first end portion to the second end portion;

an anchoring device removably coupled at least proximate to the coupling device, and configured to anchor proper disposition of the neck ornament, so that the coupling device remains at a posterior position on a person, wherein the anchoring device is weighted to substantially balance a weight of the front portion; and wherein the anchoring device comprises an attachment member to removably couple the anchoring device proximate to the coupling device, a pending member extending from the attachment member, and a decorative element connected to the pending member opposite the attachment member.

7. A neck ornament for being placed about a neck of a person comprising:

a circumscribing element configured to encompass the neck, including a front portion, a first end portion and a second end portion;

a coupling device, connected to the circumscribing element, and configured to couple the first end portion to the second end portion;

an anchoring device removably coupled at least proximate to the coupling device, and configured to anchor proper disposition of the neck ornament, so that the coupling device remains at a posterior position of a person, wherein the anchoring device is weighted to substantially balance a weight of the front portion;

wherein the anchoring device is removably coupled to the coupling device through an attachment component that is designed to allow for easy attachment of the anchoring device to the neck ornament;

wherein the anchoring device comprises an attachment member and a pending member connected to the attachment member; and wherein the anchoring device further comprises a posterior decorative element connected to the pending member.

8. The neck ornament of claim 7, wherein the anchoring device is configured to anchor proper disposition of the neck ornament primarily by weight of the anchoring device.

9. The neck ornament of claim 8, wherein the anchoring device is a weighted elongated structure.

10. The neck ornament of claim 7, further comprising a front decorative element coupled to the front portion of the circumscribing element, wherein the weight of the anchoring device is substantially similar to the weight of the front decorative element.

11. A neck ornament for being placed about a neck of a person, comprising:

a circumscribing element configured to encompass the neck, including a front portion, a first end portion and a second end portion;

a coupling device, connected to the circumscribing element, and configured to couple the first end portion to the second end portion; and an anchoring device removably coupled at least proximate to the coupling device, and configured to anchor proper disposition of the neck ornament, so that the coupling device remains at a posterior position on a person, wherein the anchoring device is weighted to substantially balance a weight of the front portion; wherein the anchoring device comprises an attachment member, a pending member connected to the attachment member and a posterior decorative element connected to the pending member.

* * * * *